US011430319B1

(12) United States Patent
Pauli et al.

(10) Patent No.: US 11,430,319 B1
(45) Date of Patent: Aug. 30, 2022

(54) CAVITATION DETECTION SYSTEM

(71) Applicant: Caterpillar Inc., Peoria, IL (US)

(72) Inventors: Nathan S Pauli, Peoria, IL (US); Pengfei Ma, Naperville, IL (US); Kalpeshkumar N. Patel, Naperville, IL (US); Richard Andrew Carpenter, Chillicothe, IL (US); James David Siegle, Washington, IL (US); Vignesh Jayakumar, Peoria, IL (US); Richard Scott Cushing, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/489,466

(22) Filed: Sep. 29, 2021

(51) Int. Cl.
*G08B 21/18* (2006.01)

(52) U.S. Cl.
CPC ..... *G08B 21/182* (2013.01)

(58) Field of Classification Search
CPC ..... G08B 21/182
See application file for complete search history.

(56) References Cited

U.S. PATENT DOCUMENTS

| | | | | |
|---|---|---|---|---|
| 5,332,356 | A * | 7/1994 | Gulich | F04D 15/0088 702/56 |
| 9,255,578 | B2 * | 2/2016 | Sharpe, Jr. | F04B 11/00 |
| 10,711,802 | B2 | 7/2020 | Hambe et al. | |
| 2019/0339162 | A1 | 11/2019 | Munk | |
| 2020/0040888 | A1 * | 2/2020 | Zhang | F04B 17/05 |
| 2020/0388140 | A1 * | 12/2020 | Gomez | F04B 49/065 |

FOREIGN PATENT DOCUMENTS

| | | | |
|---|---|---|---|
| EP | 1298511 | B1 | 3/2005 |
| JP | 2011157894 | A | 8/2011 |
| WO | WO2020024325 | | 2/2020 |

* cited by examiner

*Primary Examiner* — Ojiako K Nwugo
(74) *Attorney, Agent, or Firm* — Lee & Hayes, PLLC

(57) ABSTRACT

Cavitation that occurs within a pump of a machine, such as truck or other work machine, can potentially damage the pump and/or other components of the machine. The machine can have a cavitation monitor configured to detect cavitation and/or cavitation damage associated with the pump based on vibration data, speed data associated with mechanical movements of the pump, and operating data associated with the machine overall. If the cavitation monitor detects cavitation and/or cavitation damage, the cavitation monitor can cause corresponding alerts to be displayed to a machine operator or other user.

20 Claims, 6 Drawing Sheets

CAVITATION DETECTION SYSTEM

TECHNICAL FIELD

The present disclosure relates to detection of cavitation and/or cavitation damage associated with a pump of a machine and, more particularly, to detecting cavitation and/or cavitation damage based on vibration data associated with the pump, speed data associated with the pump, and/or operating data associated with the machine.

BACKGROUND

Vehicles and other machines often include hydraulic pumps that can be at risk of being damaged by cavitation. Cavitation can occur when movement of a piston, impeller, or other pump component generates areas of low pressure within a pump fluid that vaporize and form bubbles within the pump fluid. The bubbles can later collapse, for instance when the bubbles are subjected to areas of higher pressure within the pump fluid. The collapse of the bubbles within the pump fluid can generate shock waves that can damage components of the pump.

For example, cavitation can cause pitting of a housing of the pump and/or other components of the pump. In some instances, debris associated with cavitation damage can flow through the pump fluid, potentially damaging other portions of the pump and/or traveling through and damaging other machine components connected to the pump.

Cavitation damage can accordingly decrease the usable life of a pump, and/or lead to damage of other machine components. Machine operators and owners therefore often desire to detect cavitation, and/or cavitation damage, associated with a pump of a machine. For example, if a machine owner is aware that a pump is experiencing cavitation, the machine owner may perform maintenance or repair operations to reduce the likelihood of additional cavitation in the pump. As another example, if a machine owner is aware that a pump has experienced a certain level of cavitation damage over time, or is predicted to reach a certain level of cavitation damage at a future time, the machine owner can schedule a replacement of the pump without being surprised by an unexpected failure of the pump.

Some systems have been developed that can detect cavitation in pumps. However, many such systems are designed for specific types of pumps, and may not be applicable to a variety of types of pumps. Many such systems are also limited to evaluating specific data that may lead to false positives if a monitored pump is a component of a larger machine that experiences vibrations due to other operations unrelated to the pump itself.

For example, U.S. Patent Application. Pub. No. 2019/0339162 to Munk (hereinafter "Munk") describes a sensor assembly that is configured to use vibration data to detect motor bearing faults and cavitation. However, Munk relies on its sensor assembly being attached into a bore provided in a pump. Accordingly, it may not be possible to use Munk's system with pumps that do not have bores configured to accept a sensor assembly. Munk's system also relies on performing a frequency analysis on vibration data received from the sensor assembly, and can detect cavitation associated with a pump based on an increase of a spectral level within a specific predefined frequency band. However, if the pump is mounted within a larger machine, such as a truck, bulldozer, or other mobile machine, other operations of the machine unrelated to the pump may cause vibrations that could also lead to an increase of a spectral level in the specific predefined frequency band that Munk's system evaluates. For instance, if the pump is a hydraulic pump configured to move a bed of a haul truck, measured vibrations may be due to the haul truck driving around the worksite instead of operations of the pump to move the bed of the haul truck. If such vibrations, caused by driving a machine or other machine operations unrelated to the pump itself, lead to an increase of a spectral level in the predefined frequency band that Munk's system evaluates, Munk's system may incorrectly determine that cavitation is occuring in the pump.

The example systems and methods described herein are directed toward overcoming one or more of the deficiencies described above.

SUMMARY OF THE INVENTION

According to a first aspect, a computing system includes one or more processors and memory storing computer-executable instructions. The computer-executable instructions, when executed by the one or more processors, cause the one or more processors to perform operations. The operations include receiving vibration data from at least one vibration sensor mounted in a machine at a position proximate to a pump of the machine. The operations also include receiving speed data from at least one speed sensor, wherein the speed data indicates a speed of a mechanical element of the pump. The operations additionally include determining amplitude data associated with vibrations of the pump, based on the vibration data and the speed data. The operations also include determining, using a cavitation model and based on a plurality of values indicated by the amplitude data, a level of cavitation occurring within the pump.

According to a further aspect, a computer-implemented method includes receiving, by one or more processors, vibration data from at least one vibration sensor mounted in a machine at a position proximate to a pump of the machine. The computer-implemented method also includes receiving, by the one or more processors, speed data from at least one speed sensor, wherein the speed data indicates a speed of a mechanical element of the pump. The computer-implemented method further includes determining, by the one or more processors, amplitude data associated with vibrations of the pump, based on the vibration data and the speed data. The computer-implemented method also includes determining, by the one or more processors, and using a cavitation model based on a plurality of values indicated by the amplitude data, a level of cavitation occurring within the pump.

According to another aspect, a machine includes a pump, at least one vibration sensor, at least one speed sensor, and a cavitation monitor. The pump comprises a mechanical element, and is configured to drive movement of one or more components of the machine. The at least one vibration sensor is configured to measure vibrations associated with the pump. The at least one speed sensor is configured to measure a speed of the mechanical element of the pump. The cavitation monitor is configured to determine amplitude data associated with vibrations of the pump based on vibration data provided by the at least one vibration sensor and speed data provided by the at least one speed sensor. The cavitation monitor is also configured to determine, using a cavitation model based on a plurality of values indicated by the amplitude data, a level of cavitation occurring within the pump.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

DETAILED DESCRIPTION

Figure 1:
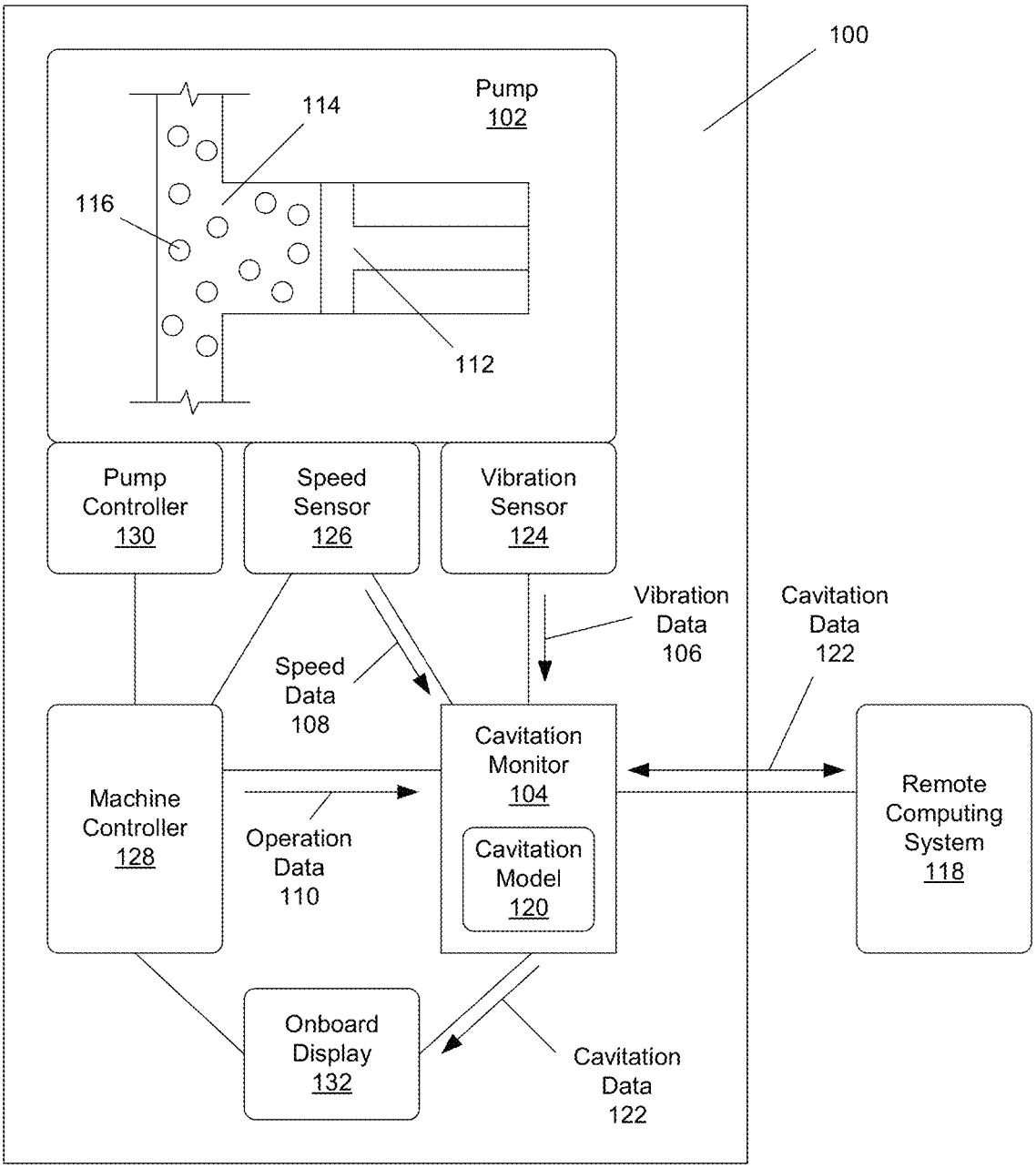
FIG. 1 shows an example schematic view of a machine that includes a pump and a cavitation monitor.

FIG. 1 shows an example schematic view of a machine 100 that includes a pump 102 and a cavitation monitor 104. The cavitation monitor 104 can be configured to detect cavitation and/or cavitation damage associated with the pump 102 based on input data, such as vibration data 106, speed data 108, and/or operation data 110.

The machine 100 can be a mobile work machine, such as a machine associated with mining, construction, paving, farming, and/or other industries. For example, the machine 100 can be a commercial machine, such as an earth-moving vehicle, mining vehicle, backhoe, scraper, dozer, loader (e.g., large wheel loader, track-type loader, etc.), shovel, material handling equipment, truck (e.g., mining truck, haul truck, on-highway truck, off-highway truck, articulated truck, etc.), a crane, a pipe layer, farming equipment, a marine vessel, an aircraft, or any other type of machine.

In some examples, the machine 100 can operate at, and move around, a worksite. The worksite can be a construction site, a mine site, a quarry, or any other type of worksite or work environment. For example, the machine 100 can be a bulldozer or other earth-moving vehicle that can drive around a worksite to move dirt, rocks, gravel, construction materials, and/or other material around the worksite.

The pump 102 of the machine 100 can be configured to drive movement of components of the machine 100. For example, the pump 102 can cause movement of a machine implement, such as a bucket, blade, or ripper of a bulldozer. In some examples, the machine 100 can have multiple pumps that can cause movement of the same or different components of the machine 100. One or more pumps can also assist with propulsion of the machine 100 around a worksite or other location.

The pump 102 can be a hydraulic pump, such as a reciprocating pump or centrifugal pump. The pump 102 can have mechanical elements 112, such as pistons, drive shafts, impellers, gears, and/or other types of mechanical or movable parts. As an example, the pump 102 can be an axial piston pump that includes a set of pistons mounted around a rotating drive shaft.

The mechanical elements 112 of the pump 102 can move to cause corresponding movement of a fluid 114 through the pump 102. For example, movement of the mechanical elements 112 can cause the fluid 114 to flow from an inlet of the pump 102 to an outlet of the pump 102. The fluid 114 can be a hydraulic fluid, such as an oil-based fluid, water-based fluid, or a synthetic fluid. As an example, the fluid 114 can have a mineral oil base stock.

As the mechanical elements 112 move, and cause movement of the fluid 114, the movement of the mechanical elements 112 can cause bubbles 116 to form within the fluid 114. For example, movement of a piston or an impeller can generate areas of low pressure within the fluid 114 that vaporize to form bubbles 116. The bubbles 116 can then collapse, for instance when the bubbles 116 are subjected to areas of higher pressure within the fluid 114. Collapse of the bubbles 116 can generate shock waves that can propagate through the fluid 114 and damage the mechanical elements 112 of the pump 102, a housing of the pump 102, and/or other components of the pump 102. The formation and/or collapse of the bubbles 116 within the fluid 114 can be known as cavitation. Damage that results from shock waves generated when the bubbles 116 collapse can be known as cavitation damage.

The cavitation monitor 104 described herein can detect cavitation and/or cavitation damage associated with the pump 102. The cavitation monitor 104 can receive input data, including vibration data 106, speed data 108, and/or operation data 110 through wired and/or wireless connections. The cavitation monitor 104, and/or a remote computing system 118 associated with the cavitation monitor 104, can also apply a cavitation model 120 to the input data to determine cavitation data 122 associated with the pump 102. The cavitation data 122 can indicate whether cavitation is currently occurring in association with the pump 102, indicate a level of cavitation currently-occurring within the pump 102, indicate whether a level of currently-occurring cavitation associated with the pump 102 exceeds a threshold level, indicate estimated current and/or future cavitation damage levels associated with the pump 102, and/or other types of information associated with cavitation in the pump 102.

The cavitation monitor 104 can include one or more electronic control modules (ECMs) or other computing devices that include integrated circuits, microprocessors, memory, and/or other computing elements. For example, the cavitation monitor 104 can include an analog to digital converter (ADC) that is configured to receive and/or convert input data, a field-programmable gate array (FPGA) that is configured to perform signal processing, one or more processors configured to perform operations on the input data according to the cavitation model 120, transmission interfaces configured to exchange data through wired or wireless connections with other elements of the machine 100, the remote computing system 118, and/or other computing elements.

The cavitation monitor 104 can receive the vibration data 106 from at least one vibration sensor 124 associated with the pump 102. At least one vibration sensor 124 can, for example, be mounted on the exterior of a housing of the pump 102, and can transmit vibration signals to the cavitation monitor 104. In some examples, more than one vibration sensor can be mounted on, or proximate to, the pump 102, and can transmit vibration data 106 to the cavitation monitor 104.

A vibration sensor can be a type of sensor, such as piezoelectric accelerometer sensor or other type of vibration sensor, that measures vibration and/or acceleration associated with the pump 102. In some examples, the vibration sensor can output analog values, such as voltage levels, that indicate measured vibration amplitudes over a range of frequencies. As discussed further below, the cavitation monitor 104 can be configured to convert such analog values to digital values that can be further processed by the cavitation monitor 104 and/or the remote computing system 118 according to the cavitation model 120. In other examples, the vibration sensor can directly output digital values that indicate measured vibration levels.

The cavitation monitor 104 can also receive speed data 108 from at least one speed sensor 126 associated with the pump 102. The speed data 108 can indicate a speed associated with a component of the pump 102. For example, the speed sensor 126 can be associated with a drive shaft of the pump 102, and can be configured to measure and output a rotational speed indicating how quickly a drive shaft of the pump 102 is rotating. The speed sensor 126 can be attached to the pump component, to an engine that drives movement of the pump component, or to any other component associated with movement of the pump component. In some examples, the cavitation monitor 104 can receive speed data 108 from multiple speed sensors associated with multiple components of the pump 102 and/or other components of the machine 100, such that the cavitation monitor 104 can determine speeds and/or relative speeds of multiple components of the pump 102 and/or the machine 100.

The cavitation monitor 104 can also receive operation data 110 from a machine controller 128 of the machine 100. The machine controller 128 can be an ECM or other on-board computing system that at least partially controls operations of the machine 100. For example, the machine controller 128 can be a primary computing system of the machine 100 that at least partially controls various operations of the machine 100 automatically and/or based on user input from a human operator. In some examples, the cavitation monitor 104 can be an element of the machine controller 128. However, in other examples, the cavitation monitor 104 can include one or more separate computing devices that can receive operation data from the machine controller 128.

The machine controller 128 can also be connected to a pump controller 130 that controls operations of the pump 102. For example, the machine controller 128 can, via the pump controller 130, automatically direct operations of the pump 102 based user commands, machine load levels, and/or other information. The pump controller 130 can also provide the machine controller 128 with data about the pump 102, such as pump pressure values, pump displacement values, flow measurements, inlet values, outlet values, temperature values, acoustic values, and/or other data associated with the pump 102.

The operation data 110 provided by the machine controller 128 to the cavitation monitor 104 can indicate user commands, machine load levels, machine driving speeds, machine component positioning data, pump data, and/or other types of data associated with operations of the pump 102 and/or the machine 100 overall. For example, the operation data 110 can indicate information associated with user commands provided via pedal presses, lever movements, and/or other types of operator-provided user input. The operation data 110 can also indicate pump data received by the machine controller 128 from the pump controller 130, such as pump pressure values, pump displacement values, flow measurements, inlet values, outlet values, temperature values, acoustic values, and/or other data associated with the pump 102.

The cavitation monitor 104 can, in some examples, be configured to pre-process and/or convert one or more types of input data, such as the vibration data 106 received from at least one vibration sensor 124, speed data 108 received from at least one speed sensor 126, and/or operation data 110 received from the machine controller 128. For example, as discussed further below with respect to FIG. 3, an ADC of the cavitation monitor 104 can be configured to receive the vibration data 106 as analog data and perform analog-to-digital conversion operations to convert the analog data into digital data. An FPGA of the cavitation monitor 104 can apply one or more types of filters on the digital data to generate amplitude data that can be evaluated based on the cavitation model 120. In some examples, the cavitation monitor 104 can generate amplitude data from the vibration data 106 and speed data 108, such that the amplitude data indicates broadband noise and/or pump harmonic signals as discussed further below with respect to FIG. 3 and FIG. 4.

In some examples, the vibration data 106 can have a relatively high sample rate, and conversion of the vibration data 106 at the cavitation monitor 104 can generate corresponding amplitude data that has a lower sample rate. As a non-limiting example, the vibration sensor 124 can provide the vibration data 106 to the cavitation at a sample rate of 100 kHz, but operations performed by the cavitation monitor 104 can generate corresponding amplitude data that has a sample rate of 10 Hz to 100 Hz.

The cavitation model 120 can be configured to, based on input data such as the vibration data 106, the speed data 108, and/or the operation data 110, determine a corresponding level of cavitation and/or cavitation damage. In some examples, the cavitation model 120 can be a lookup table. In these examples, values and/or ranges of values in the vibration data 106, the speed data 108, the operation data 110, and/or values associated with broadband noise and/or pump harmonic signals in corresponding amplitude data, can correspond to specific predefined cavitation level values and/or specific predefined cavitation damage level values indicated in the lookup table.

In other examples, the cavitation model 120 can be a machine learning model. In these examples, the cavitation model 120 can have been trained on historical data to predict, based on values in the input data and/or corresponding amplitude data, predicted levels of cavitation and/or cavitation damage. The cavitation model 120 can be a machine learning model based on convolutional neural networks, recurrent neural networks, other types of neural networks, nearest-neighbor algorithms, regression analysis, Gradient Boosted Machines (GBMs), Random Forest algorithms, deep learning algorithms, and/or other types of artificial intelligence or machine learning frameworks.

As an example, the cavitation model 120 can be trained using a supervised or unsupervised machine learning approach, for instance based on a training set of historical data. The training set can be based on operations of one or more machines, identical or similar to machine 100. For example, a set of machines similar to machine 100 can be operated over a period of time, during which vibration data 106, speed data 108, and operation data 110 associated with those machines can be collected for use as the training set of historical data. Corresponding amplitude data can also be generated from the collected vibration data 106 and speed data 108, such that data associated with broadband noise and pump harmonic signals can also be added to the training set of historical data. The pumps of the machines can also be examined for signs of cavitation and cavitation damage, such that the training set of historical data can also include measurements or other indications of actual cavitation and cavitation damage that occurred with respect to the set of machines.

The cavitation model 120 can be trained based on the training set of historical data. For example, data points in the collected input data, including the vibration data 106, speed data 108, operation data 110, and/or corresponding amplitude data, can be designated as "features" for machine learning, while measured levels of cavitation and/or cavitation damage can be designated as "labels" to be predicted by the machine learning. Machine learning algorithms, such as supervised machine learning algorithms, can operate on the training set of historical data to determine which features in the input data can be used to predict the measured levels of cavitation and/or cavitation damage, determine weights for those features and/or combinations of features, and/or otherwise determine how values in the input data correspond to the measured levels of cavitation and/or cavitation damage. Accordingly, after the cavitation model 120 has been trained on the training set of historical data, the trained cavitation model 120 can be used to predict cavitation and/or cavitation damage associated with the pump 102 based on new input data received by the cavitation monitor 104 as described herein.

In still other examples, the cavitation model 120 can be based on one or more formulas. For example, the cavitation model 120 can use matrix multiplication to convert one or more values in amplitude data, generated based on vibration data 106 and speed data 108, into signals indicative of normal behavior of the pump 102, cavitation, and/or cavitation damage. For instance, inputs to the cavitation model 120 can include two or more amplitudes of broadband noise and/or pump harmonic signals (such as frequencies of the primary pump harmonic signals and secondary pump harmonic signals discussed below with respect to FIG. 2). In some examples, the inputs to the cavitation model 120 can be determined based on one or more frequency selection filters. A matrix of coefficients for the matrix multiplication can be based on predetermined expected proportions between each of the amplitudes during normal behavior of the pump 102, behavior of the pump 102 when cavitation is occurring, and/or behavior of the pump 102 when the pump 102 has experienced cavitation damage. The matrix multiplication can be based on equations associated with each unknown, such as normal behavior, cavitation, and/or cavitation damage. For instance, at least three input amplitudes can be provided to the cavitation model 120, such that the matrix multiplication can be used to solve for three values indicating levels of normal pump behavior, cavitation, and cavitation damage.

The cavitation model 120 can also use one or more formulas that can normalize amplitudes, indicated by the amplitude data, based on the operation data 110 and/or other data. For example, the cavitation model 120 can use one or more formulas, indicating how amplitudes are expected to change based on speeds, pressure levels, flow levels, and/or other data, to normalize amplitudes in the amplitude data. In some examples, such formulas can be applied in the cavitation model 120 before or after the matrix multiplication discussed above. The normalization formulas can, in some examples, use scale and/or offset values that are a function of operating conditions. As a non-limiting example, the cavitation model 120 can use the following normalization formula to determine a normalized amplitude value from a raw amplitude value:

$$\text{amplitude}_{normalized}=\text{scale}*(\text{amplitude}_{raw}-\text{offset}).$$

In some examples, the cavitation model 120 can also use one or more formulas, such as a monotonic non-linear function, that limit the influence, in the cavitation model 120, of amplitudes that are high and/or low relative to other amplitudes. As a non-limiting example, the cavitation model 120 can use the following formula to limit the influence of high and/or low amplitudes:

$$\text{output}=y_0*\left(1-\tanh\left(\frac{\text{input}-x_0}{x_1}\right)\right).$$

Formulas used in some examples of the cavitation model 120 can cause the cavitation model 120 to operate similarly to a neural network, with coefficients that can be manually set or defined. However, as discussed above, in other examples the cavitation model 120 can be a neural network or other type of machine learning model, such that coefficients or other values used in the cavitation model 120 can be automatically determined by training the machine learning model.

In some examples, the cavitation monitor 104 can apply the cavitation model 120 to input data received from the vibration sensor 124, the speed sensor 126, and/or the machine controller 128. For example, the cavitation monitor 104 can apply the cavitation model 120 after converting one or more types of input data into amplitude data as described further below. In these examples, the cavitation monitor 104 can accordingly use the cavitation model 120 to determine cavitation data 122 associated with the pump 102, based on the received input data and/or generated amplitude data.

In other examples, the cavitation monitor 104 can transmit input data received from the vibration sensor 124, the speed sensor 126, and/or the machine controller 128 to the remote computing system 118. In some examples, the cavitation monitor 104 can also convert one or more types of input data into amplitude data as described below, and then transmit converted and/or unconverted input data to the remote computing system 118. For example, the cavitation monitor 104 can transmit generated amplitude data to the remote computing system 118 instead of, or in addition to, received vibration data 106, speed data 108, and/or operation data 110. The remote computing system 118 can apply the cavitation model 120 to the received data to determine corresponding cavitation data 122 associated with the pump 102, and return the cavitation data 122 to the cavitation monitor 104.

In some examples, the cavitation monitor 104 can be configured to initially send input data and/or corresponding amplitude data to the remote computing system 118, such that the remote computing system 118 can use the received data to develop or train the cavitation model 120, and/or so that the remote computing system 118 can determine corresponding cavitation data 122 remotely. However, once the remote computing system 118 has developed the cavitation model 120, for instance after remote training of the cavitation model 120 has completed, the remote computing system 118 can transmit a copy of the cavitation model 120 to the cavitation monitor 104 so that the cavitation monitor 104 can use the cavitation model 120 on-board the machine 100 to determine cavitation data 122 based on input data directly and locally. Similarly, in some examples, the cavitation monitor 104 can be occasionally or periodically updated, for instance through a wired or wired connection, to use a new or different cavitation model.

In some examples or situations, the cavitation monitor 104 can cause some or all of the cavitation data 122, or a corresponding alert, to be displayed via an onboard display 132 of the machine 100. The onboard display 132 may be a display screen, indicator light, dial, meter, or any other type of display that can be viewed by an operator of the machine 100. As an example, if the cavitation monitor 104 or the remote computing system 118 generates cavitation data 122 indicating that the pump 102 is currently experiencing cavitation at a level that meets or exceeds a predefined threshold, the cavitation monitor 104 can cause the onboard display 132 to display a cavitation alert or warning associated with the pump 102. As another example, the cavitation monitor 104 can cause the onboard display 132 to display some or all of the cavitation data 122, for instance in diagnostic user interface (UI) screens associated with the pump 102.

As discussed above, the cavitation model 120 can be configured to determine levels of cavitation and/or cavitation damage associated with the pump 102. In some examples, the cavitation model 120 can be configured to, at least in part, determine the levels of cavitation and/or cavitation damage associated with the pump 102 based on noise and/or pump harmonic signals indicated by amplitudes of the vibration data 106. An example of such noise and pump harmonic signals within vibration amplitudes, from which cavitation and/or cavitation damage can be identified, is shown in FIG. 2.

Figure 2:
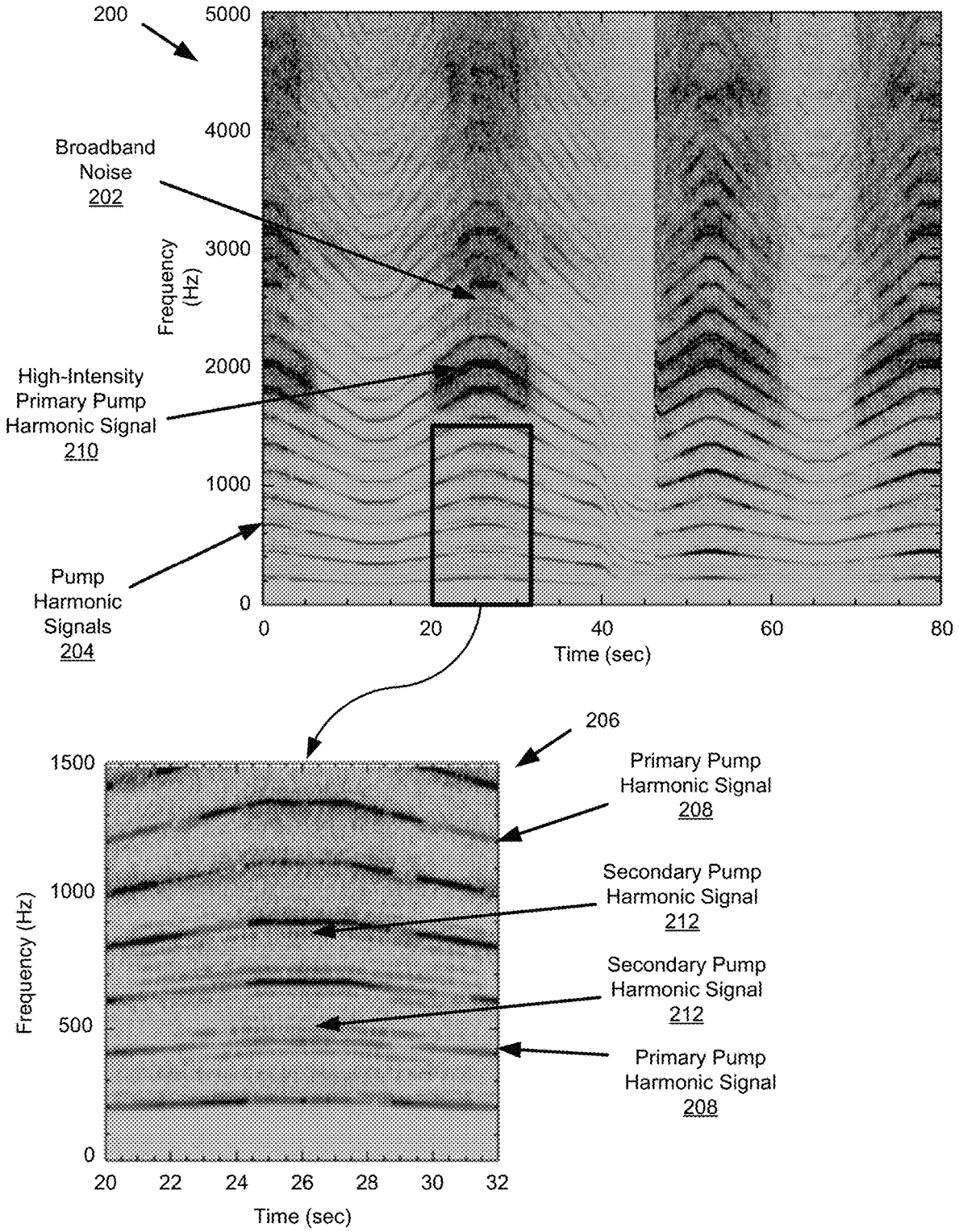
FIG. 2 shows a graph of example vibration amplitudes that includes noise and pump harmonic signals indicative of cavitation and/or cavitation damage.

FIG. 2 shows a graph 200 of example vibration amplitudes that includes noise and pump harmonic signals indicative of cavitation and/or cavitation damage. In this example, the graph 200 shows vibration amplitudes at frequencies ranging from 0 Hz to 5000 Hz over a time period of 80 seconds. The graph 200 can be generated from input data associated with the pump 102, including vibration data 106 and speed data 108. In some examples, the cavitation monitor 104 can generate amplitude data from vibration data 106 and speed data 108 using the process shown in FIG. 3.

Overall, the graph 200 indicates that amplitudes associated with the vibration data 106 are higher during time periods in which the speed data 108 indicates that components of the pump 102 were moving at higher speeds, and that amplitudes associated with the vibration data 106 are lower during time periods in which the speed data 108 indicates that components of the pump 102 were moving at lower speeds or were not moving. Overall, cavitation and/or cavitation damage can be more likely to occur during the higher-speed and higher-amplitude time periods, as pump components moving at higher speeds can be more likely to cause bubbles 116 to form in the fluid 114 and lead to cavitation in the pump 102.

Shock waves caused by collapsing bubbles 116 in the fluid 114 during cavitation can cause vibrations to occur at random across a wide range of frequencies, which can be indicated by broadband noise 202 in the graph 200. However, in many situations, other vibrations associated with operation of the machine 100 can also lead to broadband noise 202. For instance, if the machine 100 is mobile and is driving around a worksite, vibrations associated with driving the machine 100 may be the cause of, or contribute to, the broadband noise 202. Similarly, operations of an engine of the machine 100 during work operations, and/or movement of other components of the machine 100 that are not associated with the pump 102, can be the cause of, or contribute to, the broadband noise 202. Accordingly, broadband noise 202 in vibration amplitude data may not be indicative, in isolation, of cavitation and/or cavitation damage associated with the pump 102.

The graph 200 can also indicate pump harmonic signals 204. The pump harmonic signals 204 can be present at amplitudes that are multiples of a frequency associated with mechanical operations of the pump 102. For example, if the pump 102 is an axial piston pump that has pistons mounted around a drive shaft, the pump harmonic signals 204 can be associated with multiples of a frequency associated with rotation of the drive shaft. The frequency associated with the rotation of the drive shaft, and thus the amplitudes of the related pump harmonic signals 204, can increase during higher rotation speeds of the drive shaft. Accordingly, the amplitudes of the related pump harmonic signals 204 can rise and fall in the graph 200 over time based on the speed data 108, as discussed above.

As shown in a close-up view 206 of a portion of the graph 200, the pump harmonic signals 204 can include primary pump harmonic signals 208. The primary pump harmonic signals 208 can be present at certain predefined multiples of the frequency associated with mechanical operation of the pump 102. The predefined multiples of the frequency can be based on a number of mechanical elements 112 within the pump 102. For example, if the pump 102 is an axial piston pump that has a set of nine pistons mounted around a single drive shaft, the primary pump harmonic signals 208 can be present at every ninth multiple of a drive shaft rotation frequency. As another example, if the axial piston pump has a set of seven pistons mounted around a single drive shaft, the primary pump harmonic signals 208 can be present at every seventh multiple of the drive shaft rotation frequency.

Due to the construction of the pump 102, the primary pump harmonic signals 208 can be present in graph 200 at certain predefined multiples of the frequency associated with mechanical operation of the pump 102, regardless of whether cavitation is or is not occurring. For example, the amplitudes of the primary pump harmonic signals 208 can rise and fall in the graph 200 over time based on speeds of the drive shaft indicated by the speed data 108, as discussed above. However, if cavitation is occurring within the pump 102, one or more of the primary pump harmonic signals 208 may increase in intensity and/or be surrounded by increased noise levels due to the collapse of bubbles 116. For example, darker portions of primary pump harmonic signals 208 in graph 200, such as high-intensity primary pump harmonic signal 210, can indicate that cavitation is occuring within the pump 102.

Additionally, when cavitation is occurring within the pump 102, secondary pump harmonic signals 212 can appear at other multiples of the frequency associated with mechanical operation of the pump 102, between the primary pump harmonic signals 208. For example, although the primary pump harmonic signals 208 can be present at every ninth multiple of a drive shaft rotation frequency (if the pump 102 has nine pistons mounted around the drive shaft), secondary pump harmonic signals 212 may appear at every first multiple of the drive shaft rotation frequency when cavitation is occurring within the pump 102.

As noted above, the broadband noise 202 shown in graph 200 may be insufficient on its own to indicate when cavitation is occuring within the pump 102, as the broadband noise 202 may be caused by vibrations of the machine 100 that are unrelated to cavitation. However, detection of at least one high-intensity primary pump harmonic signal 210 and/or secondary pump harmonic signals 212 between primary pump harmonic signals 208 can, in addition to detection of broadband noise 202, indicate a strong likelihood that cavitation is occuring in the pump 102.

In some examples, the cavitation monitor 104 can be configured to convert input data, including vibration data 106 and speed data 108, into amplitude data similar to data shown in graph 200. The cavitation monitor 104 and/or the remote computing system 118 can use the amplitude data to detect broadband noise 202, high-intensity primary pump harmonic signals, and/or secondary pump harmonic signals 212, and use such detected noise and/or harmonic signals to detect cavitation and/or cavitation damage associated with the pump 102. For example, values associated with broadband noise 202, high-intensity pump harmonic signals, and/or secondary pump harmonic signals 212, or the absence of such noise or signals, can be input values to the cavitation model 120. Other input values, such as pump data, machine load levels, and/or other types of operation data 110 can also be input values to the cavitation model 120. Accordingly, the cavitation monitor 104 or the remote computing system 118 can use the cavitation model 120 to detect cavitation and/or cavitation damage based on signals and noise in amplitude data generated by the cavitation monitor 104, and in some examples additionally based on values provided in operation data 110. An example system the cavitation monitor 104 can use to generate amplitude data from vibration data 106 and speed data 108 is described below with respect to FIG. 3.

Figure 3:
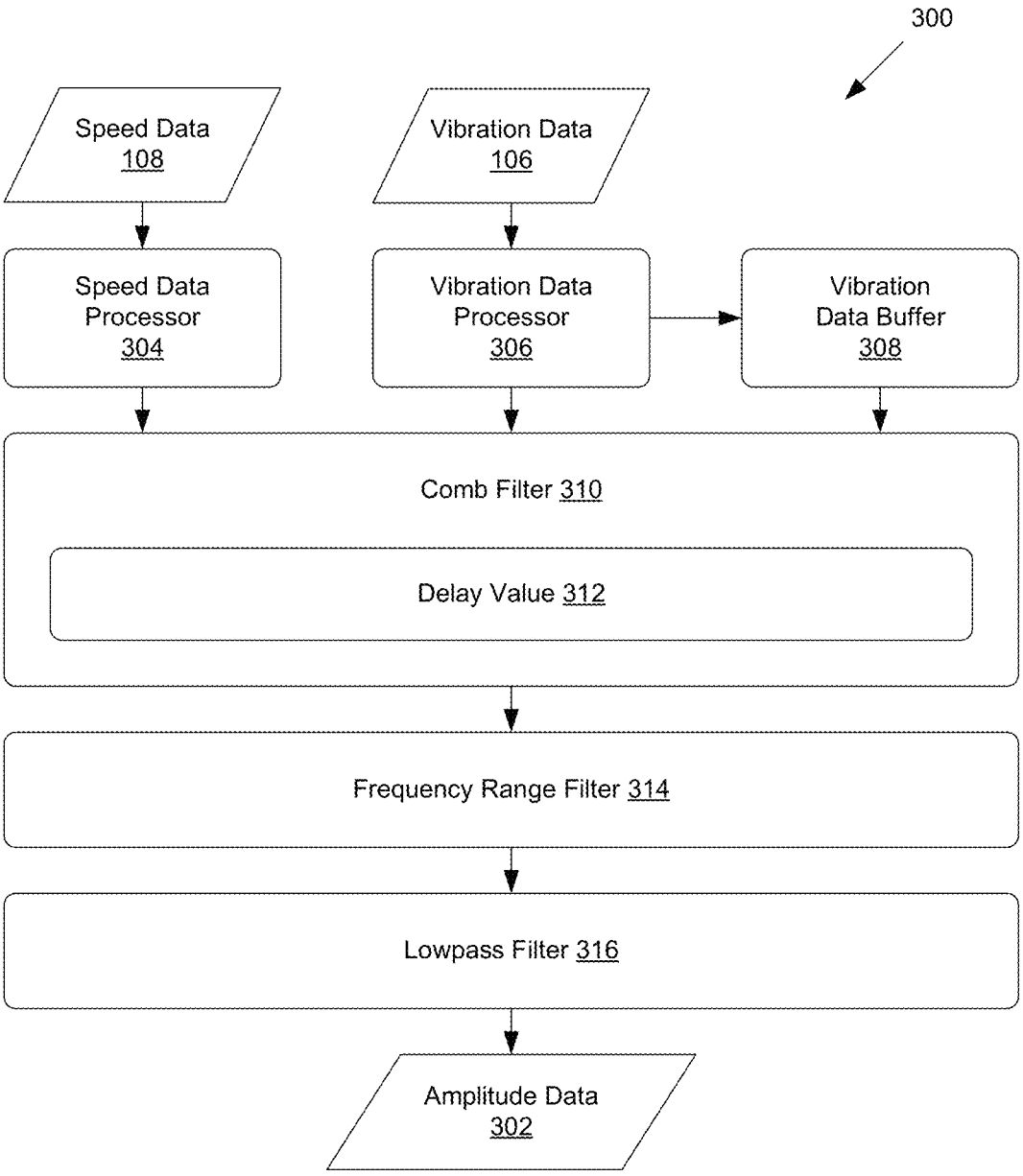
FIG. 3 shows an example system the cavitation monitor can use to generate amplitude data associated with the pump based on vibration data and speed data.

FIG. 3 shows an example system 300 the cavitation monitor 104 can use to generate amplitude data 302 associated with the pump 102 based on vibration data 106 and speed data 108. The generated amplitude data 302 can indicate frequencies associated with the vibration data 106, and can indicate broadband noise 202 and/or pump harmonic signals 204, as shown in FIG. 2. The system 300 can include a speed data processor 304, a vibration data processor 306, a vibration data buffer, a comb filter 310, a frequency range filter 314, a lowpass filter 316, and/or other elements. In some examples, the system 300 can be implemented by one or more devices that include FPGAs, ADCs, digital signal processors (DSPs), microprocessors, and/or other processing elements, for example as discussed below with respect to FIG. 6.

The speed data processor 304 can be configured to receive speed data 108 from at least one speed sensor 126 associated with the pump 102. The speed data processor 304 can also be configured to perform one or more data processing and/or conversion operations on the speed data 108. For example, if the received speed data 108 indicates a rotation speed of a drive shaft of the pump 102, the speed data processor 304 can use the speed data 108 to determine timing data indicating how long it takes for the drive shaft to complete a full rotation. In some examples, if the cavitation monitor 104 receives speed data 108 from multiple speed sensors, the same speed data processor 304, or different speed data processors, can perform processing and/or conversion operations on speed data 108 received from different speed sensors. The speed data processor 304 can provide the raw and/or converted speed data 108 to the comb filter 310.

The vibration data processor 306 can be configured to convert vibration data 106 received from at least one vibration sensor 124 associated with the pump 102. For example, the vibration sensor 124 can provide vibration data 106 to the cavitation monitor 104 as analog voltage values, and the vibration data processor 306 can perform analog to digital conversion operations to convert the analog values to digital values. The vibration data processor 306 can provide the converted vibration data 106 to a vibration data buffer 308 and to the comb filter 310.

The vibration data buffer 308 can be a memory buffer, such as a circular buffer, that at least temporarily stores vibration data values in memory for a period of time. The comb filter 310 can access vibration data values stored in the vibration data buffer 308 as described further below, for instance to compare current vibration data values received from the vibration data processor 306 against older vibration data values stored in the vibration data buffer 308. In some examples, if multiple vibration sensors are placed on, or proximate to, the pump 102, the system 300 can have a distinct vibration data buffer for each of the vibration sensors such that different vibration data buffers can separately store vibration data values associated with different vibration sensors.

The comb filter 310 can be a filter that combines vibration data 106 received directly from the vibration data processor 306 with corresponding delayed vibration data 106 stored in the vibration data buffer 308, which can generate frequency data based on constructive and negative interference between the combined vibration data. The comb filter 310 can be configured with a delay value 312 determined based on raw and/or converted speed data 108 received from the speed data processor 304, such as a timing data value determined by the speed data processor 304. In some examples, the delay value 312 can be variable, such that as the delay value 312 can change in response to changes in the speed data 108. In other examples, the system 300 can have multiple comb filters associated with different delay values, such that the system 300 can select which comb filter to use based on the current speed data 108 or corresponding timing data. Based on the delay value 312, the comb filter 310 can retrieve a delayed value of the vibration data 106 from the vibration data buffer 308, and combine the delayed vibration data value to a current vibration data value received from the vibration data processor 306 to generate output frequency data. The comb filter 310 can accordingly isolate or identify portions of the vibration data 106 that repeat over time, such as periodic signals in the vibration data 106.

For example, if the speed data 108 indicates a rotation speed of a drive shaft of the pump 102, the speed data processor 304 may determine corresponding timing data indicating how long it takes for the drive shaft to complete a full rotation. In this example, the delay value 312 can be, or correspond with, the time it takes for the drive shaft to complete a full rotation. Accordingly, the comb filter 310 can combine a current value of the vibration data 106 associated with a current rotational position of the drive shaft with an older value of the vibration data 106 retrieved from the vibration data buffer 308 that corresponds with the same rotational position of the drive shaft during a previous rotation.

The system 300 can perform an envelope analysis on the frequency data output by the comb filter 310 to determine the amplitude data 302. The amplitude data 302 can indicate amplitudes of frequencies in the periodic signals identified by the comb filter 310. The system 300 can perform the envelope analysis using the frequency range filter 314 and/or the lowpass filter 316.

The frequency range filter 314 can select or filter frequency data at defined frequency ranges. For example, if one or more specific frequency ranges are determined to be more likely to show signs of cavitation in the pump 102 than other frequency ranges, the frequency range filter 314 may select data from the specific frequency ranges for further analysis with the lowpass filter 316. In other examples, the frequency range filter 314 can be absent, or be configured to select the full range of frequencies output by the comb filter 310.

The lowpass filter 316 can be configured to generate the amplitude data 302 based on absolute values of the frequency data output by the comb filter 310 and/or the frequency range filter 314. The lowpass filter 316 can, in some examples, reduce the sample rate of the data. As a non-limiting example, the vibration data 106 and/or the speed data 108 provided to the system 300 can have a sample rate of 100 kHz, but the amplitude data 302 output by the lowpass filter 316 can have a lower sample rate of 10 Hz to 100 Hz.

The amplitude data 302 produced by the combination of the comb filter 310, the frequency range filter 314, and/or the lowpass filter 316 can be used as input for the cavitation model 120 at the cavitation monitor 104, and/or at the remote computing system 118. For example, the cavitation model 120 can use broadband noise 202 and pump harmonic signals 204 detected within the amplitude data 302, or corresponding values, to detect cavitation and/or cavitation damage associated with the pump 102, as discussed below with respect to FIG. 4.

Although FIG. 3 shows example types of operations and filters that can be used to process the vibration data 106 and/or the speed data 108 and generate the amplitude data 302, in other examples the cavitation monitor 104 can use different and/or additional types of operations and/or filters on the vibration data 106 and/or the speed data 108. For example, the cavitation monitor 104 can perform resampling operations, autocorrelation operations, coherence operations, fast Fourier transform operations, time synchronous averaging operations, Goertzel operations, other types of filtering operations, masking operations, linear interpolation operations, and/or other operations to generate the amplitude data 302.

Figure 4:
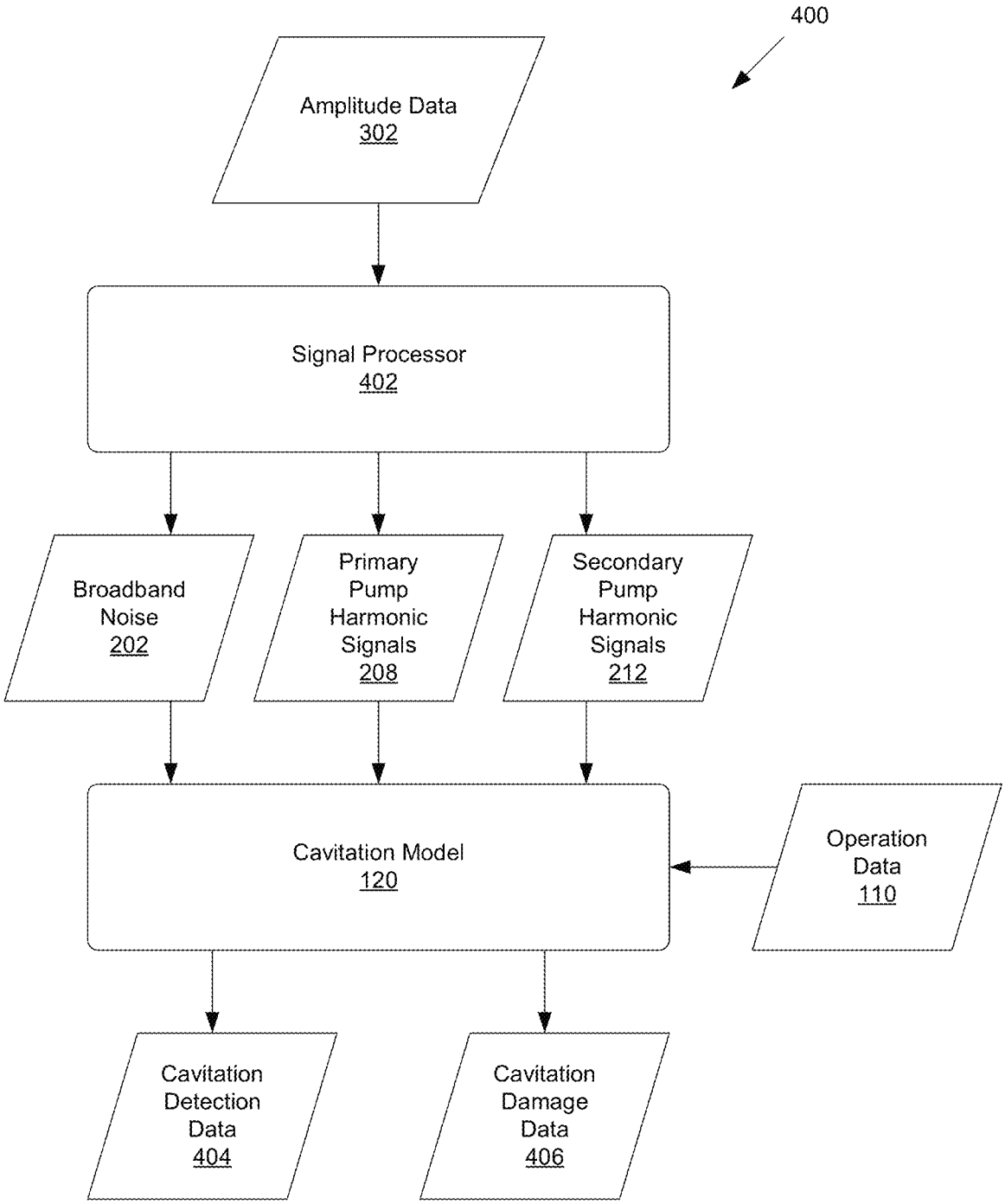
FIG. 4 shows an example system for applying the cavitation model to detect cavitation and/or cavitation damage associated with the pump.

FIG. 4 shows an example system 400 for applying the cavitation model 120 to detect cavitation and/or cavitation damage associated with the pump 102. The system 400 can apply the cavitation model 120 to amplitude data 302 generated by the cavitation monitor 104 based on vibration data 106 and speed data 108, for instance using the system 300 shown in FIG. 3. The system 400 can also use operation data 110 associated with the machine 110 as an input to the cavitation model 120.

In some examples, the system 400 can be associated with the cavitation monitor 104, such that the cavitation monitor 104 can locally apply the cavitation model 120 to amplitude data 302 generated by the cavitation monitor 104 and/or to operation data 110 received by the cavitation monitor 104. In other examples, the system 400 can be associated with the remote computing system 118. In these examples, the remote computing system 118 can receive the amplitude data 302 and/or operation data 110 from the cavitation monitor 104, and can apply the amplitude data 302 and/or operation data 110 to the cavitation model 120 remotely from the machine 100.

The system 400 can have at least one signal processor 402 that is configured to detect and/or separate broadband noise 202, primary pump harmonic signals 208, and/or secondary pump harmonic signals 212 within the amplitude data 302. As discussed above, the cavitation monitor 104 can generate the amplitude data 302 based on vibration data 106 and speed data 108 associated with the pump 102, and the amplitude data 302 can indicate broadband noise 202, primary pump harmonic signals 208, and/or secondary pump harmonic signals 212 as shown in FIG. 2. In some examples, the signal processor 402 can identify primary pump harmonic signals 208 that are associated with higher intensities and/or increased noise levels relative to other primary pump harmonic signals 208 or threshold values, and determine that those primary pump harmonic signals 208 are high-intensity primary pump harmonic signals such as the high-intensity primary pump harmonic signal 210 shown in FIG. 2.

The system 400 can use the broadband noise 202, primary pump harmonic signals 208, and/or secondary pump harmonic signals 212 detected within the amplitude data 302 as inputs to the cavitation model 120. In some examples, the system 400 can also use operation data 110 as input to the cavitation model 120, including information associated with user commands, machine load levels, machine driving speeds, machine component positioning data, pump data, and/or other types of data associated with operations of the pump 102 and/or the machine 100 overall.

The cavitation model 120 can be configured to output cavitation detection data 404 and/or cavitation damage data 406 based on provided input data, including values associated with the broadband noise 202, primary pump harmonic signals 208, secondary pump harmonic signals 212, and/or operation data 110. In some examples, the cavitation model 120 can be a lookup table that indicates predetermined cavitation values and/or predetermined cavitation damage values that correspond with different combinations of values indicated by the broadband noise 202, primary pump harmonic signals 208, secondary pump harmonic signals 212, and/or operation data 110. For instance, if input data indicates a certain level of broadband noise 202 in combination with high-intensity primary harmonic signals and/or secondary pump harmonic signals 212, and/or certain values of one or more types of operation data 110, the combination of those input values can map to an expected level of cavitation and/or an expected level of cavitation damage in the lookup table.

In other examples, the cavitation model 120 can include formulas and/or a trained machine learning model that can generate a predicted level of current cavitation associated with the pump 102, and/or current or future levels of cavitation damage associated with the pump 102, based on values indicated by the input data. For example, based on input data that indicates a level of broadband noise 202 in combination with high-intensity primary harmonic signals and/or secondary pump harmonic signals 212, and/or certain values of one or more types of operation data 110, the cavitation model 120 can predict a current level of cavitation occuring within the pump 102, predict a current level of cavitation damage associated with the pump 102, and/or predict a future level of cavitation damage associated with the pump 102.

Accordingly, the system 400 can use the cavitation model 120 to, based on the provided input data, generate and output cavitation detection data 404 that indicates an estimated level of cavitation currently occuring in the pump 102. In some examples, the system 400 can similarly use the cavitation model 120 to generate and output corresponding cavitation damage data 406 that indicates an estimated level of current and/or future cavitation damage associated with the pump 102. In other examples, the system 400 can increment a historical cavitation damage estimate associated with the pump 102, and thus generate cavitation damage data 406, based on an estimate of the current cavitation occuring in the pump 102 in addition to a previous estimate of cavitation damage associated with the pump 102.

The cavitation detection data 404 and/or cavitation damage data 406 can be used to provide users with alerts or warnings associated with the pump 102. For example, the cavitation monitor 104 can be configured to present an alert or warning, via the onboard display 132 of the machine 100, if the cavitation detection data 404 indicates that the pump 102 is currently experiencing cavitation at a level that exceeds a predefined cavitation threshold. Similarly, if the cavitation damage data 406 indicates that the pump 102 is currently associated with a level of cavitation damage that exceeds a cavitation damage threshold, or that cavitation damage associated with the pump 102 is projected to exceed a cavitation damage threshold within a threshold period of time, the cavitation monitor 104 can display a corresponding alert or warning to an operator of the machine via the onboard display 132, and/or the remote computing system 118 can provide a corresponding alert or notification to another user. Examples of such alerts are described below with respect to FIG. 5.

Figure 5:
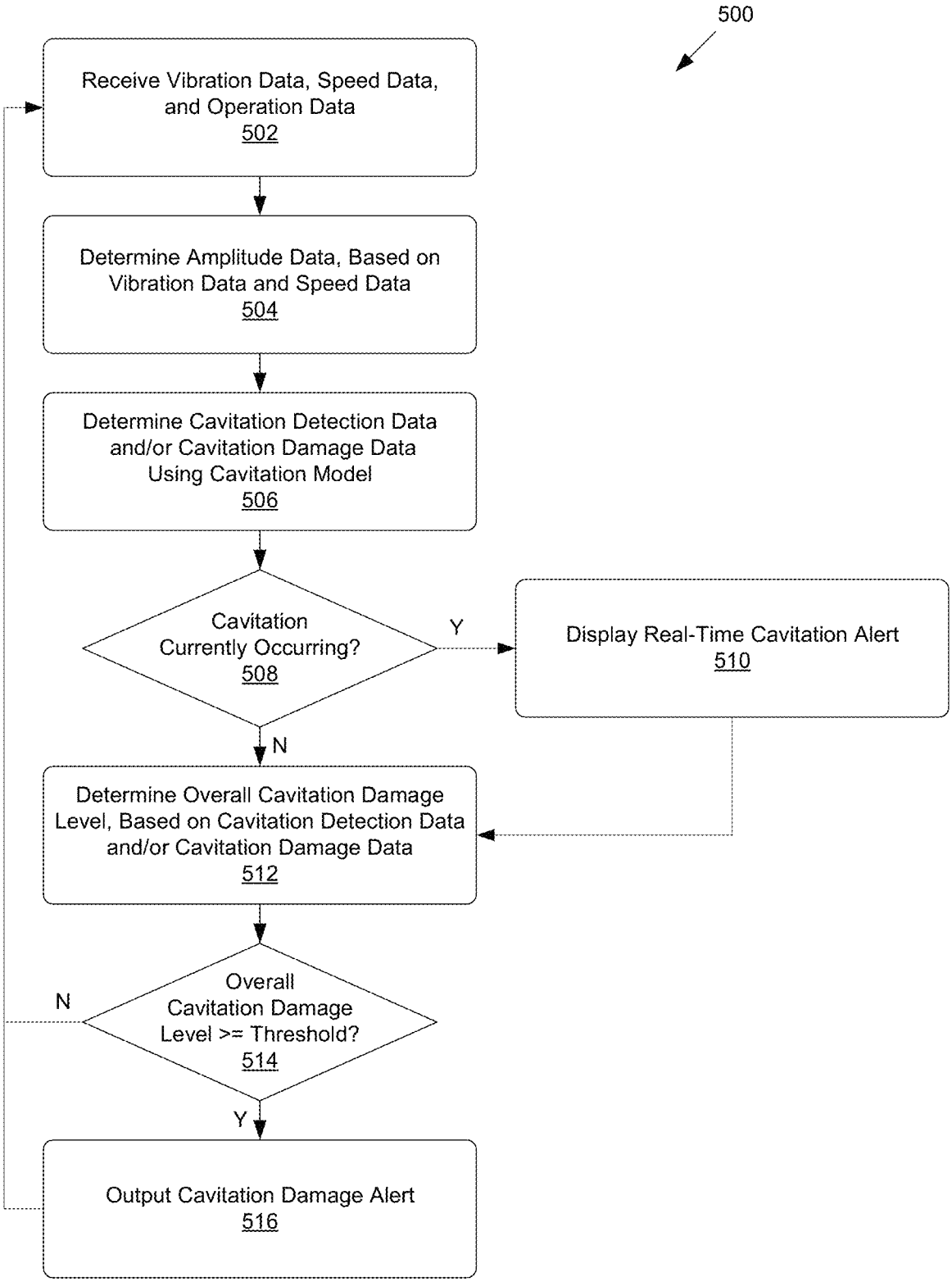
FIG. 5 shows a flowchart illustrating an example process for alerting users about cavitation and/or cavitation damage associated with the pump.

FIG. 5 shows a flowchart 500 illustrating an example process for alerting users about cavitation and/or cavitation damage associated with the pump 102. At least some of the blocks of the process shown in FIG. 5 can be executed by the cavitation monitor 104. In some examples, the remote computing system 118 can assist the cavitation monitor 104 by executing one or more of the blocks of the process shown in FIG. 5 based on data received from the cavitation monitor 104.

At block 502, the cavitation monitor 104 can receive the vibration data 106, the speed data 108, and the operation data 110. The cavitation monitor 104 can receive the vibration data 106 from at least one vibration sensor 124 mounted on, or proximate to, the pump 102. The cavitation monitor 104 can receive the speed data 108 from at least one speed sensor 126 associated with the pump 102. The cavitation monitor 104 can receive the operation data 110 from the machine controller 128. The operation data 110 can include pump data that the machine controller 128 received from the pump controller 130, as well as other data associated with the machine 100 such as user commands, machine load levels, machine driving speeds, machine component positioning data, and/or other types of data.

At block 504, the cavitation monitor 104 can determine amplitude data 302, based on the vibration data 106 and the speed data 108. For example, the cavitation monitor 104 can use the system 300 shown in FIG. 3 to determine timing data and/or the delay value 312 based on the speed data 108. The cavitation monitor 104 can also apply the comb filter 310 to current vibration data 106 and older vibration data 106 retrieved from the vibration data buffer 308 based on the delay value 312, and use the frequency range filter 314 and/or lowpass filter 316 to generate the amplitude data 302.

At block 506, the cavitation monitor 104 or the remote computing system 118 can use the cavitation model 120 to determine cavitation detection data 404 and/or cavitation damage data 406 associated with the pump 102. As an example, the cavitation monitor 104 can use one or more values indicated by, or derived from, the amplitude data 302 determined at block 504 and/or the operation data 110 received at block 502, as inputs to the cavitation model 120. As another example, the cavitation monitor 104 can transmit the amplitude data 302 determined at block 504 and the operation data 110 received at block 502 to the remote computing system 118, and the remote computing system 118 can use values indicated by, or derived from, the amplitude data 302 and/or the operation data 110 as inputs to the cavitation model 120. As described above, the cavitation model 120 can be a lookup table or be based on formulas and/or a trained machine learning model that can output, based on a combination of values indicated by the inputs, corresponding cavitation detection data 404 and/or cavitation damage data 406.

At block 508, the cavitation monitor 104 or the remote computing system 118 can determine whether the cavitation detection data 404 indicates that cavitation is currently occurring within the pump 102. If the cavitation detection data 404 indicates that cavitation is currently occurring within the pump 102 (Block 508—Yes), the cavitation monitor 104 or the remote computing system 118 can cause a display of a real-time cavitation alert associated with the pump 102 at block 510.

As an example, at block 510, the cavitation monitor 104 can cause the onboard display 132 to display a cavitation alert if the cavitation detection data 404 indicates that cavitation is currently occurring within the pump 102. As another example, at block 510, the remote computing system 118 can cause the cavitation monitor 104 to display a cavitation alert via the onboard display 132, display a cavitation alert to a user of the remote computing system 118, or transmit a cavitation alert notification to another user.

In some examples, the cavitation monitor 104 or the remote computing system 118 can be configured to cause the display of a real-time cavitation alert if the cavitation detection data 404 indicates that currently-occurring cavitation within the pump 102 meets or exceeds a predefined threshold cavitation level. For instance, if the detected currently-occurring cavitation is under the predefined threshold cavitation level, the cavitation may be minimal and unlikely to result in cavitation damage. Accordingly, the cavitation monitor 104 or the remote computing system 118 can avoid prompting the display of a real-time cavitation alert. However, if the detected currently-occurring cavitation is at or above the predefined threshold cavitation level, and thus may result in cavitation damage, the cavitation monitor 104 or the remote computing system 118 can cause a display of a corresponding real-time cavitation alert at block 510.

At block 512, the cavitation monitor 104 or the remote computing system 118 can determine an overall cavitation damage level associated with the pump 102, based on the cavitation detection data 404 and/or cavitation damage data 406 determined at block 506. In some examples, the operations of block 512 can be performed after causing the display of a real-time cavitation alert at block 510, if cavitation detection data 404 determined at block 506 indicates that cavitation is not currently occurring within the pump 102 (Block 508—No), if cavitation detection data 404 determined at block 506 at under a threshold value, if cavitation detection data 404 was not determined at block 506, and/or in other situations.

In some examples, the cavitation damage data 406 can directly indicate a current and/or predicted future cavitation damage level associated with the pump 102. Accordingly, the cavitation monitor 104 or the remote computing system 118 can use the cavitation damage data 406 determined at block 506 to determine the overall cavitation damage level associated with the pump 102 at block 512. In other examples, the cavitation monitor 104 or the remote computing system 118 can track a historical overall cavitation damage level associated with the pump 102, and the cavitation monitor 104 or the remote computing system 118 can increment the historical overall cavitation damage level associated with the pump 102 at block 512 based on a level of currently-occuring cavitation indicated by the cavitation detection data 404.

At block 514, the cavitation monitor 104 or the remote computing system 118 can determine whether the overall cavitation damage level associated with the pump 102 meets or exceeds a predefined cavitation damage threshold. In some examples, the predefined cavitation damage threshold can be a cavitation damage level at which the pump 102 may be dangerous to continue operating, such as a level at which the cavitation damage may be likely to cause the pump 102 to fail or to damage other machine components. In other examples, the predefined cavitation damage threshold can be a cavitation damage level at which the pump 102 is still operable, but should be scheduled for maintenance or replacement within the machine 100.

As an example, if the pump 102 is expected to fail or cause damage to other components of the machine 100 when the cavitation damage associated with the pump 102 reaches a first value, the predefined cavitation damage threshold can be set at a second value that is lower than the first value. Accordingly, the process shown in FIG. 5 can determine when the cavitation damage associated with the pump 102 is approaching, but has not yet reached, a level at which the pump 102 is expected to fail or cause damage to other machine components.

If the overall cavitation damage level associated with the pump 102 is below the predefined cavitation damage threshold (Block 514—No), additional vibration data 106, speed data 108, and operation data 110 can be received at block 502. This additional data can be used at block 506 and block 508 to determine whether cavitation and/or cavitation damage is occurring at a later point in time.

However, if the overall cavitation damage level associated with the pump 102 is below the predefined cavitation damage threshold (Block 514—Yes), the cavitation monitor 104 or the remote computing system 118 can cause a display of a cavitation damage alert associated with the pump 102 at block 516. As an example, at block 516, the cavitation monitor 104 can cause the onboard display 132 to display a cavitation damage alert if the overall cavitation damage level associated with the pump meets or exceeds the predefined cavitation damage threshold. As another example, at block 516, the remote computing system 118 can cause the cavitation monitor 104 to display a cavitation damage alert via the onboard display 132, display a cavitation damage alert to a user of the remote computing system 118, or transmit a cavitation damage alert notification to another user. After causing display of the cavitation damage alert at block 516, additional vibration data 106, speed data 108, and operation data 110 can be received at block 502. This additional data can be used at block 506 and block 508 to determine whether cavitation and/or cavitation damage is occurring at a later point in time.

Figure 6:
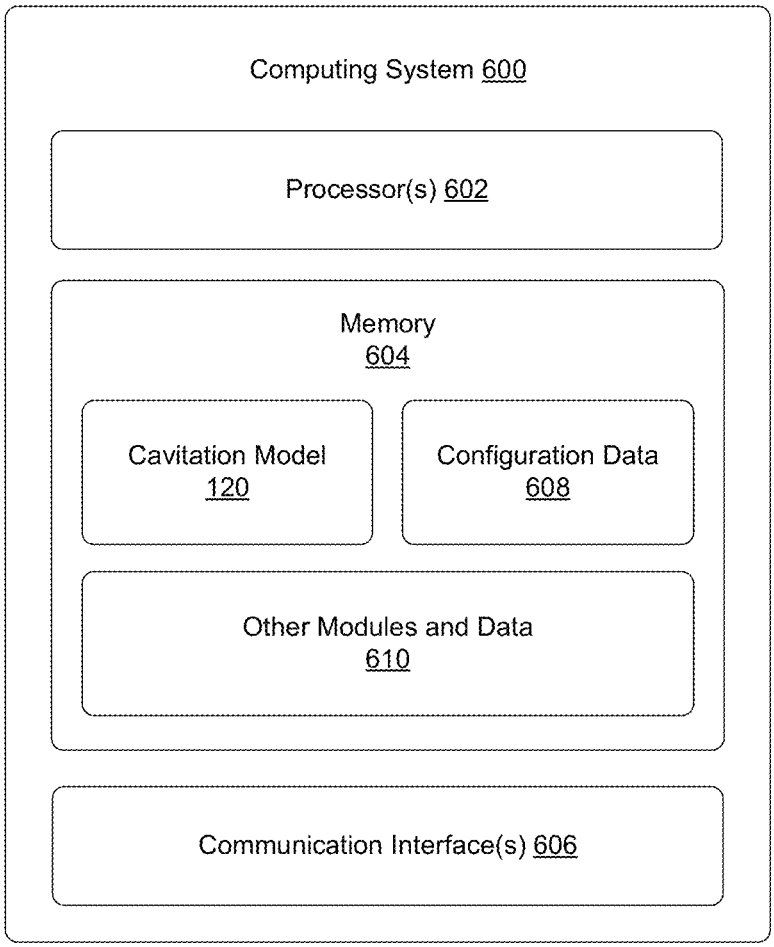
FIG. 6 shows an example system architecture for a computing system.

FIG. 6 shows an example system architecture for a computing system 600. The computing system 600 can be a computing system that is configured to apply the cavitation model 120, such as the cavitation monitor 104 or the remote computing system 118. The computing system 600 can also be the machine controller 128 in examples in which the cavitation monitor 104 is an element of the machine controller 128. The computing system 600 can include one or more computing devices or other controllers, such as ECMs, programmable logic controllers (PLCs), or other computing elements, that include one or more processors 602, memory 604, and communication interfaces 606.

The processor(s) 602 can operate to perform a variety of functions as set forth herein. The processor(s) 602 can include one or more chips, microprocessors, integrated circuits, and/or other processing units or components known in the art. For example, the processor(s) 602 can include microprocessors, central processing units (CPUs), graphics processing units (GPUs), and/or other processing units. In some examples, the processor(s) 602 can have one or more arithmetic logic units (ALUs) that perform arithmetic and logical operations, and/or one or more control units (CUs) that extract instructions and stored content from processor cache memory, and executes such instructions by calling on the ALUs during program execution. The processor(s) 602 can also access content and computer-executable instructions stored in the memory 604, and execute such computer-executable instructions. The processor(s) 602 can also include or be associated with other types of computing or data processing elements that can receive, convert, and/or operate on data, such as ADCs, application specific integrated circuits (ASICs), FPGAs and/or other programmable circuits, other integrated circuits, DSPs, and/or other types of elements that can operate on data independently and/or in conjunction with microprocessors, CPUs, or other types of processor(s) 602.

The memory 604 can be volatile and/or non-volatile computer-readable media including integrated or removable memory devices including random-access memory (RAM), read-only memory (ROM), flash memory, a hard drive or other disk drives, a memory card, optical storage, magnetic storage, and/or any other computer-readable media. The computer-readable media can be non-transitory computer-readable media. The computer-readable media can be configured to store computer-executable instructions that can be executed by the processor(s) 602 to perform the operations described herein.

For example, the memory 604 can include a drive unit and/or other elements that include machine-readable media. A machine-readable medium can store one or more sets of instructions, such as software or firmware, that embodies any one or more of the methodologies or functions described herein. The instructions can also reside, completely or at least partially, within the processor(s) 602 and/or communication interface(s) 606 during execution thereof by the computing system 600. For example, the processor(s) 602 can possess local memory, which also can store program modules, program data, and/or one or more operating systems.

The memory 604 can store the cavitation model 120 discussed above, such that the computing system 600 can apply the cavitation model 120 to received input data, amplitude data generated from received input data, and/or other data. The memory 604 can also store configuration data 608 associated with the cavitation model 120 and/or the cavitation monitor 104. In some examples, the configuration data 608 can indicate configurations for some or more elements of the system 300, such as an identifier of a specific comb filter, among a set of comb filters, to use within the system 300, or an indication of a particular frequency range to be used by the frequency range filter 314. In other examples, the configuration data 608 can indicate predefined cavitation threshold levels and/or cavitation damage threshold levels. Accordingly, if the cavitation model 120 indicates that a pump is experiencing cavitation or cavitation damage at levels that exceed the threshold levels indicated by the configuration data 608, the computing system 600 can cause a machine to display a corresponding cavitation alert or other cavitation data 122. The memory 604 can also store other modules and data 610 that can be utilized by the computing system 600 to perform or enable performing any action taken by the computing system 600. For example, the other modules and data 610 can include a platform, operating system, and/or applications, as well as data utilized by the platform, operating system, and/or applications.

The communication interfaces 606 can include analog input and/or outputs, digital inputs and/or outputs, Ethernet ports, serial ports, USB ports, other wired network interfaces, wireless network interfaces, transceivers, modems, antennas, and/or other data transmission components. For instance if the computing system 600 is the cavitation monitor 104, the communication interfaces 606 can include analog inputs through which the cavitation monitor 104 can receive vibration data 106 from a vibration sensor and/or speed data 108 from a speed sensor, one or more Ethernet connections or other digital data interfaces through which the cavitation monitor 104 can receive operation data 110 from the machine controller 128 and/or communicate with the onboard display 132, a cellular modem or other wireless network interface through which the cavitation monitor 104 can exchange data with the remote computing system 118, and/or other types of communication interfaces 606.

INDUSTRIAL APPLICABILITY

The pump 102 in the machine 100 can experience cavitation, and/or accrue cavitation damage over time. The cavitation monitor 104 in the machine 100, and/or the remote computing system, can use the cavitation model 120 to detect when cavitation is occuring within the pump 102 and/or to estimate a level of cavitation damage associated with the pump 102. When cavitation occurs within the pump 102, the systems and methods described herein can cause a real-time cavitation alert to be displayed to a user, such as an operator of the machine. Similarly, if the estimated cavitation damage associated with the pump 102 reaches a threshold level, the systems and methods described herein can cause a cavitation damage alert to be displayed to a user.

The real-time cavitation alert and/or cavitation damage alert can allow users to adjust usage of the pump 102, and/or plan maintenance and replacement schedules. For example, if an operator of the machine 100 is using the machine 100, and a real-time cavitation alert is displayed via the onboard display 132, the operator can understand that the current operations of the machine 100 may be causing cavitation within the pump 102 that may damage the pump 102. Accordingly, the operator may at least temporarily pause operation of the machine 100 or adjust machine operations to reduce the likelihood of cavitation occurring within the pump 102.

As another example, the systems and methods described can cause a cavitation damage alert to be displayed to a user, such as a site manager or fleet manager. The cavitation damage alert can indicate that the pump 102 has accrued cavitation damage to at least a threshold level, and may be at risk of failing and/or causing damage to other components of the machine 100 at a future time. Accordingly, the user can adjust fleet maintenance schedules to schedule a replacement of the pump 102 within the machine 100 before the pump 102 actually fails or causes damage to other components of the machine 100.

While aspects of the present disclosure have been particularly shown and described with reference to the embodiments above, it will be understood by those skilled in the art that various additional embodiments may be contemplated by the modification of the disclosed machines, systems, and method without departing from the spirit and scope of what is disclosed. Such embodiments should be understood to fall within the scope of the present disclosure as determined based upon the claims and any equivalents thereof

What is claimed is:

1. A computing system, comprising:

one or more processors; and memory storing computer-executable instructions that, when executed by the one or more processors, cause the one or more processors to perform operations comprising:

receiving vibration data from at least one vibration sensor mounted in a machine at a position proximate to a pump of the machine;

receiving speed data from at least one speed sensor, wherein the speed data indicates a speed of a mechanical element of the pump;

determining amplitude data associated with vibrations of the pump, based on the vibration data and the speed data; and determining, using a cavitation model and based on a plurality of values indicated by the amplitude data, a level of cavitation occuring within the pump.

2. The computing system of claim 1, wherein the amplitude data indicates one or more of:

broadband noise, primary pump harmonic signals at predefined multiples of a frequency associated with the mechanical element of the pump, or secondary pump harmonic signals at other multiples of the frequency, between the predefined multiples.

3. The computing system of claim 2, wherein the cavitation model is configured to detect the level of cavitation based at least in part on one or more of the broadband noise, the primary pump harmonic signals, or the secondary pump harmonic signals.

4. The computing system of claim 2, wherein determining the amplitude data comprises:

determining a delay value for a comb filter based on the speed data;

applying the comb filter to the vibration data and to historical vibration data stored in a vibration data buffer, based on the vibration data; and applying one or more of a frequency range filter or a lowpass filter to output of the comb filter.

5. The computing system of claim 2, wherein the mechanical element of the pump is a drive shaft, and the predefined multiples are associated with a number of pistons mounted to the drive shaft.

6. The computing system of claim 1, further comprising:

receiving operation data associated with the machine from a machine controller, wherein the operation data comprises pump data received by the machine controller from a pump controller of the pump, and wherein the level of cavitation occuring within the pump is determined, using the cavitation model, based on the plurality of values indicated by the amplitude data and additional values indicated by the operation data.

7. The computing system of claim 1, wherein the operations further comprise:

determining that the level of cavitation is at or above a predefined cavitation threshold; and causing display of a real-time cavitation alert, in response to determining that the level of cavitation is at or above the predefined cavitation threshold.

8. The computing system of claim 1, wherein the operations further comprise:

detecting a level of cavitation damage associated with the pump by applying the cavitation model to the amplitude data.

9. The computing system of claim 8, wherein the operations further comprise:

determining that the level of cavitation damage is at or above a predefined cavitation damage threshold; and causing display of a cavitation damage alert, in response to determining that the level of cavitation damage is at or above the predefined cavitation damage threshold.

10. The computing system of claim 1, wherein the cavitation model is a lookup table.

11. The computing system of claim 1, wherein the cavitation model is a machine learning model that has been trained on a training set of historical data.

12. A computer-implemented method, comprising:

receiving, by one or more processors, vibration data from at least one vibration sensor mounted in a machine at a position proximate to a pump of the machine;

receiving, by the one or more processors, speed data from at least one speed sensor, wherein the speed data indicates a speed of a mechanical element of the pump;

determining, by the one or more processors, amplitude data associated with vibrations of the pump, based on the vibration data and the speed data; and determining, by the one or more processors, and using a cavitation model based on a plurality of values indicated by the amplitude data, a level of cavitation occuring within the pump.

13. The computer-implemented method of claim 12, wherein the amplitude data indicates one or more of:

broadband noise, primary pump harmonic signals at predefined multiples of a frequency associated with the mechanical element of the pump, or secondary pump harmonic signals at other multiples of the frequency, between the predefined multiples.

14. The computer-implemented method of claim 12, further comprising determining, by the one or more processors, that the level of cavitation is at or above a predefined cavitation threshold; and causing, by the one or more processors, display of a real-time cavitation alert, in response to determining that the level of cavitation is at or above the predefined cavitation threshold.

15. The computer-implemented method of claim 12, further comprising:

detecting, by the one or more processors, a level of cavitation damage associated with the pump by applying the cavitation model to the amplitude data.

16. The computer-implemented method of claim 15, further comprising:

determining, by the one or more processors, that the level of cavitation damage is at or above a predefined cavitation damage threshold; and causing, by the one or more processors, display of a cavitation damage alert, in response to determining that the level of cavitation damage is at or above the predefined cavitation damage threshold.

17. A machine, comprising:

a pump comprising a mechanical element, wherein the pump is configured to drive movement of one or more components of the machine;

at least one vibration sensor configured to measure vibrations associated with the pump;

at least one speed sensor configured to measure a speed of the mechanical element of the pump; and a cavitation monitor configured to:

determine amplitude data associated with vibrations of the pump based on vibration data provided by the at least one vibration sensor and speed data provided by the at least one speed sensor; and determine, using a cavitation model based on a plurality of values indicated by the amplitude data, a level of cavitation occuring within the pump.

18. The machine of claim 17, wherein the amplitude data indicates one or more of:

broadband noise, primary pump harmonic signals at predefined multiples of a frequency associated with the mechanical element of the pump, or secondary pump harmonic signals at other multiples of the frequency, between the predefined multiples.

19. The machine of claim 17, further comprising an onboard display, and wherein the cavitation monitor is further configured to:

determine that the level of cavitation is at or above a predefined cavitation threshold; and cause display of a real-time cavitation alert via the onboard display, in response to determining that the level of cavitation is at or above the predefined cavitation threshold.

20. The machine of claim 17, further comprising an onboard display, and wherein the cavitation monitor is further configured to:

detect a level of cavitation damage associated with the pump by applying the cavitation model to the amplitude data;

determine that the level of cavitation damage is at or above a predefined cavitation damage threshold; and cause display of a cavitation damage alert via the onboard display, in response to determining that the level of cavitation damage is at or above the predefined cavitation damage threshold.

* * * * *